US010760839B2

(12) United States Patent
Yamaguchi et al.

(10) Patent No.: US 10,760,839 B2
(45) Date of Patent: Sep. 1, 2020

(54) INDOOR UNIT OF AIR-CONDITIONING APPARATUS HAVING LEAKED REFRIGERANT VENTILATION

(71) Applicant: Mitsubishi Electric Corporation, Tokyo (JP)

(72) Inventors: Kouji Yamaguchi, Tokyo (JP); Hiroaki Makino, Tokyo (JP); Tetsuya Tazawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 128 days.

(21) Appl. No.: 15/537,013

(22) PCT Filed: Mar. 26, 2015

(86) PCT No.: PCT/JP2015/001751
§ 371 (c)(1),
(2) Date: Jun. 16, 2017

(87) PCT Pub. No.: WO2016/151642
PCT Pub. Date: Sep. 29, 2016

(65) Prior Publication Data

US 2017/0343258 A1 Nov. 30, 2017

(51) Int. Cl.
*F25B 49/02* (2006.01)
*F24F 1/0007* (2019.01)
(Continued)

(52) U.S. Cl.
CPC ..... *F25B 49/02* (2013.01); *F24F 1/0003* (2013.01); *F24F 1/0007* (2013.01); *F24F 11/30* (2018.01);
(Continued)

(58) Field of Classification Search
CPC ..... F25B 49/02; F25B 2500/222; F24F 11/30; F24F 11/36; F24F 1/0003; F24F 1/0007;
(Continued)

(56) References Cited

U.S. PATENT DOCUMENTS 6,085,531 A 7/2000 Numoto et al.
6,199,396 B1 * 3/2001 Aizawa ..... F16K 1/10 137/360
(Continued)

FOREIGN PATENT DOCUMENTS

EP 2110614 A1 * 10/2009 ..... F25B 49/005
JP H09-324928 A 12/1997
(Continued)

OTHER PUBLICATIONS

Office Action dated Dec. 5, 2017 corresponding to JP patent application No. 2017-507119 (and English translation attached).
(Continued)

*Primary Examiner* — Travis C Ruby
(74) *Attorney, Agent, or Firm* — Posz Law Group, PLC

(57) ABSTRACT

In an indoor unit of an air-conditioning apparatus, an air inlet for room air is provided at a position lower than a height position of a drain pan. A partition plate is provided to partition a space below a height position of the drain pan in a housing. A pipe connecting portion connected to a refrigerant pipe of an outdoor unit is provided in one part of the partitioned space and a heat exchanger and a fan are placed in the other part of the partitioned space. At least one communicating path is formed in the partition plate to communicate the two parts of the partitioned space with each other. The indoor unit can include a controller for activating a fan when leakage of refrigerant is detected or for closing the communicating path when leakage of refrigerant is detected.

15 Claims, 6 Drawing Sheets

(51) Int. Cl.

| | |
|---|---|
| ***F24F 11/36*** | (2018.01) |
| ***F24F 13/22*** | (2006.01) |
| ***F24F 13/20*** | (2006.01) |
| ***F24F 1/0003*** | (2019.01) |
| ***F24F 11/30*** | (2018.01) |
| *F24F 110/00* | (2018.01) |

(52) U.S. Cl.
CPC ..... *F24F 11/36* (2018.01); *F24F 13/20* (2013.01); *F24F 13/222* (2013.01); *F24F 2013/227* (2013.01); *F24F 2110/00* (2018.01); *F25B 2500/222* (2013.01)

(58) Field of Classification Search
CPC ..... F24F 13/20; F24F 13/222; F24F 2110/00; F24F 2013/227
See application file for complete search history.

(56) References Cited

U.S. PATENT DOCUMENTS 6,425,253 B1 * 7/2002 Gale ..... B60H 1/00978 62/129
6,637,232 B1 * 10/2003 Harshberger ..... F24F 1/0007 62/285
2009/0107157 A1 * 4/2009 Dube ..... F25B 49/005 62/149
2013/0098576 A1 * 4/2013 Fujitaka ..... F24F 1/0007 165/11.1
2015/0362204 A1 * 12/2015 Goel ..... F24F 11/36 62/180
2016/0109162 A1 4/2016 Suzuki et al.
2016/0363358 A1 * 12/2016 Papas ..... F25B 49/005

FOREIGN PATENT DOCUMENTS

| | | | |
|---|---|---|---|
| JP | 11-304226 | A | 11/1999 |
| JP | 2001-165468 | A | 6/2001 |
| JP | 2002-098346 | A | 4/2002 |
| JP | 2003-074894 | A | 3/2003 |
| JP | 2005-282981 | A | 10/2005 |
| JP | 2013-44515 | A | 3/2013 |
| JP | 2015-055448 | A | 3/2015 |

OTHER PUBLICATIONS

International Search Report of the International Searching Authority dated Jun. 30, 2015 for the corresponding International application No. PCT/JP2015/001751(and English translation).

* cited by examiner

INDOOR UNIT OF AIR-CONDITIONING APPARATUS HAVING LEAKED REFRIGERANT VENTILATION

This application is a U.S. national stage application of PCT/JP2015/001751 filed on Mar. 26, 2015, the contents of which are incorporated herein by reference.

TECHNICAL FIELD

The present invention relates to an indoor unit of an air-conditioning apparatus.

BACKGROUND ART

Conventional air-conditioning apparatuses mainly use R410A, which is an HFC refrigerant, as a refrigerant filled into a refrigerant circuit. R410A has an ozone depletion potential (ODP) of zero and does not deplete the ozone layer, unlike conventional HCFC refrigerants such as R22, but has the property of high global warming potential (GWP). Consequently, to prevent global warming, the trend is setting toward an HFC refrigerant with a low GWP from an HFC refrigerant such as R410A with a high GWP.

Examples of such low-GWP HFC refrigerants include halogenated hydrocarbons having carbon double bonds in the composition, and the representative examples include HFO-1234yf (CF3CF═CH2, tetrafluoropropane), HFO-1234ze (CF3-CH═CHF), and HFO-1123 (CF2=CHF). These refrigerants are types of HFC refrigerants, but are often referred to as HFO using the initial (O) of olefin because unsaturated hydrocarbons with carbon double bonds are often called olefins. Thus, the unsaturated hydrocarbons with carbon double bonds will be referred to herein as HFO refrigerants in distinction from HFC refrigerants without a carbon double bond in the composition, such as R32 (CH2F2, difluoromethane) and R125 (CHF2-CF3, pentafluoroethane) included in R410A.

Such a low-GWP HFO refrigerant can be used as a single component refrigerant, but is highly likely to be used as a mixture of plural refrigerants in combination with an HFC refrigerant as typified by R32. The HFO refrigerant or a mixture of HFO refrigerant and HFC refrigerant is not highly flammable as HC refrigerant such as R290 (C3H8, propane), but is mildly flammable unlike R410A, which is non-flammable. Consequently, care must be taken against refrigerant leakage, and hereinafter a refrigerant having any of flammability levels ranging from mild flammability to high flammability will be referred to as a flammable refrigerant. R32 as a single component refrigerant has mild flammability similarly to the HFO refrigerant, that is, a mixture of HFO refrigerant and R32, which are flammable, is also flammable. Note that R410A, which is a mixture of R32 and R125, is non-flammable due to a property of R125.

Generally, refrigerant can leak due to a poor connection or corrosion of a refrigerant pipe configured to circulate refrigerant between an indoor unit and an outdoor unit. Unless measures are taken, the leaking refrigerant can accumulate in the indoor unit at a concentration no lower than a flammable concentration. If the leaking refrigerant reaches a high concentration and flows out of the indoor unit and an ignition source is close to the indoor unit, the leaking refrigerant may catch fire. The ignition may damage, for example, a surface of the indoor unit. Thus, to prevent ignition of the leaking refrigerant, measures need to be taken.

Patent Literature 1 discloses a configuration in which refrigerant leaking out of a heat exchanger placed in a heat exchange chamber is caused to flow into a pipe chamber through a drain pan and the refrigerant leakage is detected by a sensor provided in the pipe chamber. Any leaking refrigerant detected is blown out of the indoor unit by operating a fan. This configuration prevents refrigerant from accumulating in the indoor unit at a concentration no lower than a flammable concentration. According to Patent Literatures 2 and 3, a hole is formed in a house wall, a pipe of an air passageway extending from the outdoor unit is passed through the wall, and leaking refrigerant is caused to flow outdoors through the air passageway.

CITATION LIST

Patent Literature

Patent Literature 1: Japanese Unexamined Patent Application Publication No. 2002-98346

Patent Literature 2: Japanese Unexamined Patent Application Publication No. 2001-165468

Patent Literature 3: Japanese Unexamined Patent Application Publication No. 9-324928

SUMMARY OF INVENTION

Technical Problem

The configuration described in Patent Literature 1 has a problem in that, if refrigerant leaks in a machine room, the leaking refrigerant accumulates in the machine room at least until the refrigerant reaches a height position of a drain pan, and remains in the machine room in high concentrations. With Patent Literatures 2 and 3, to cause the refrigerant to flow out of the indoor unit, an air passageway extending from the indoor unit has to be provided, complicating a structure. Also, a hole has to be opened in a house wall and a pipe of the air passageway has to be inserted into the hole in the wall as well, posing also a problem in that installation is not easy.

The present invention has been made to solve the above problems and has an object to provide an indoor unit of an air-conditioning apparatus, where the indoor unit can be installed easily and can cause leaking refrigerant to flow out of the indoor unit quickly.

Solution to Problem

An indoor unit of an air-conditioning apparatus according to one embodiment of the present invention includes a housing in which an air inlet and an air outlet for room air are provided, a connection pipe provided with a pipe connecting portion connected to a refrigerant pipe of an outdoor unit through a relay pipe, a heat exchanger configured to exchange heat between refrigerant flowing in from the outdoor unit through the connection pipe and air sucked into the housing, a fan configured to suck air into the housing through the air inlet, and blow the air subjected to heat exchange by the heat exchanger out of the housing through the air outlet, to generate an air current, a drain pan provided below the heat exchanger and configured to accumulate drain water caused by the heat exchange between the refrigerant and the air, and a partition plate provided to partition a space below the height position of the drain pan in the housing. The air inlet is placed at a position lower than a height position of the drain pan, the pipe connecting portion is placed in one part of the partitioned space, the heat exchanger and the fan are placed in the other part of the partitioned space, and a communicating path is formed in the partition plate to communicate the two parts of the partitioned space with each other.

Advantageous Effects of Invention

The indoor unit of an air-conditioning apparatus according to one embodiment of the present invention can be installed easily and can cause leaking refrigerant to flow out of the indoor unit quickly.

DESCRIPTION OF EMBODIMENTS

Embodiment 1

Figure 1:
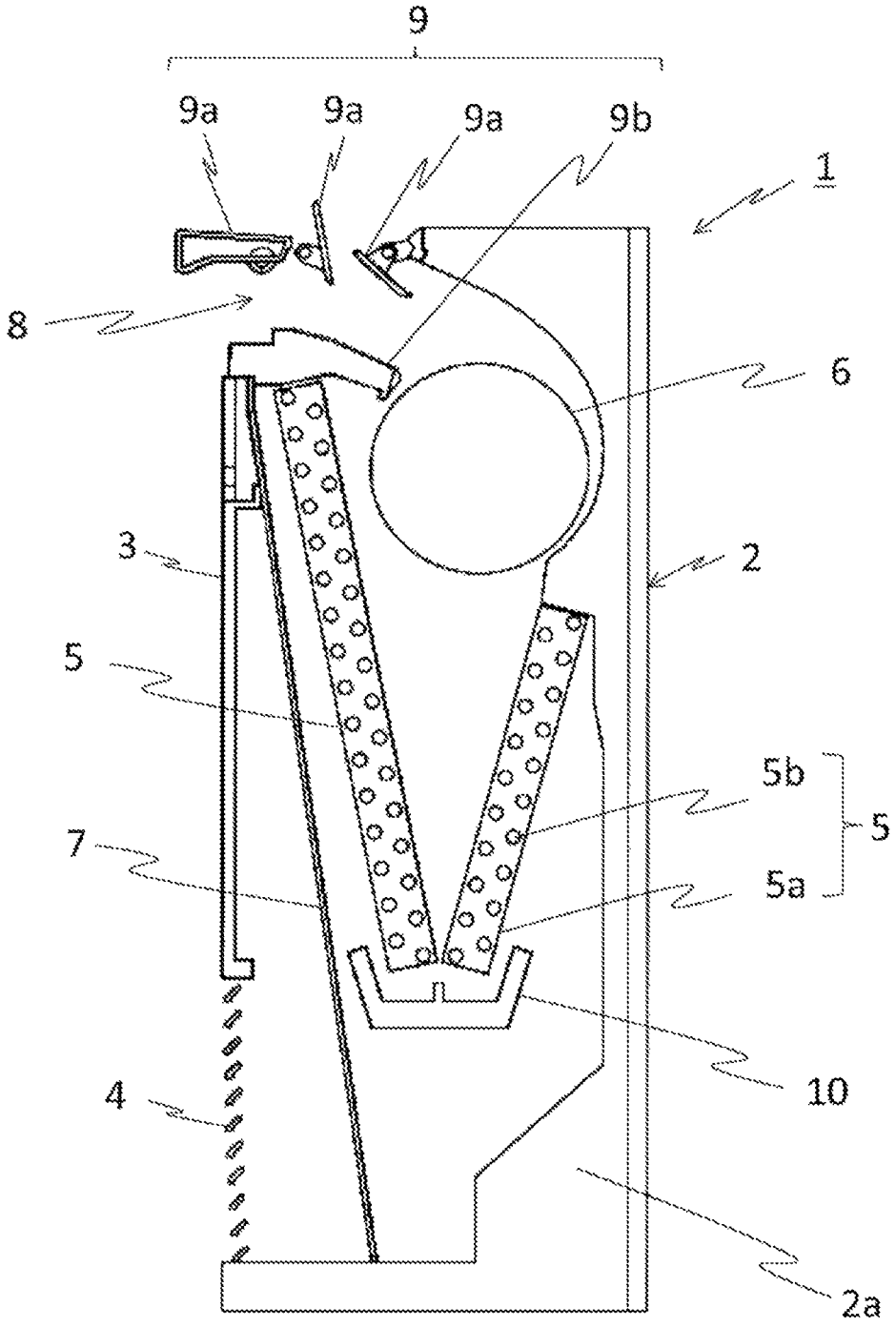
FIG. 1 is a sectional view of an indoor unit of an air-conditioning apparatus according to Embodiment 1 of the present invention.
Figure 2:
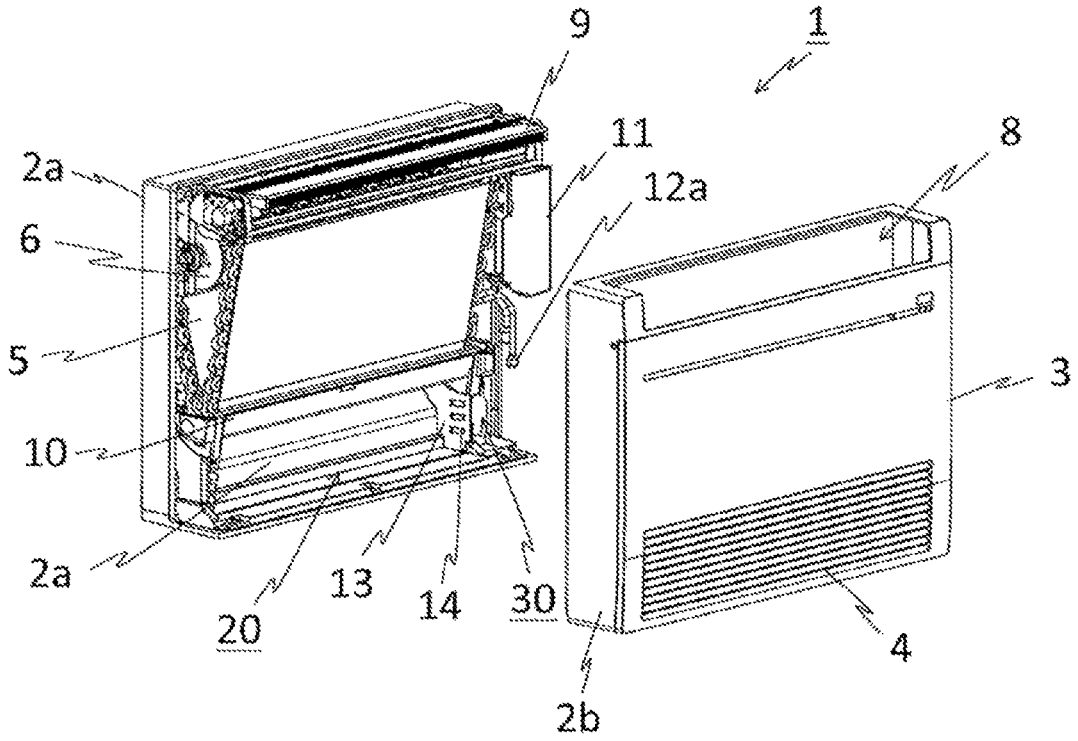
FIG. 2 is a perspective view of the indoor unit of FIG. 1 as viewed obliquely with a front-side casing, a front panel, and a filter removed.
Figure 3:
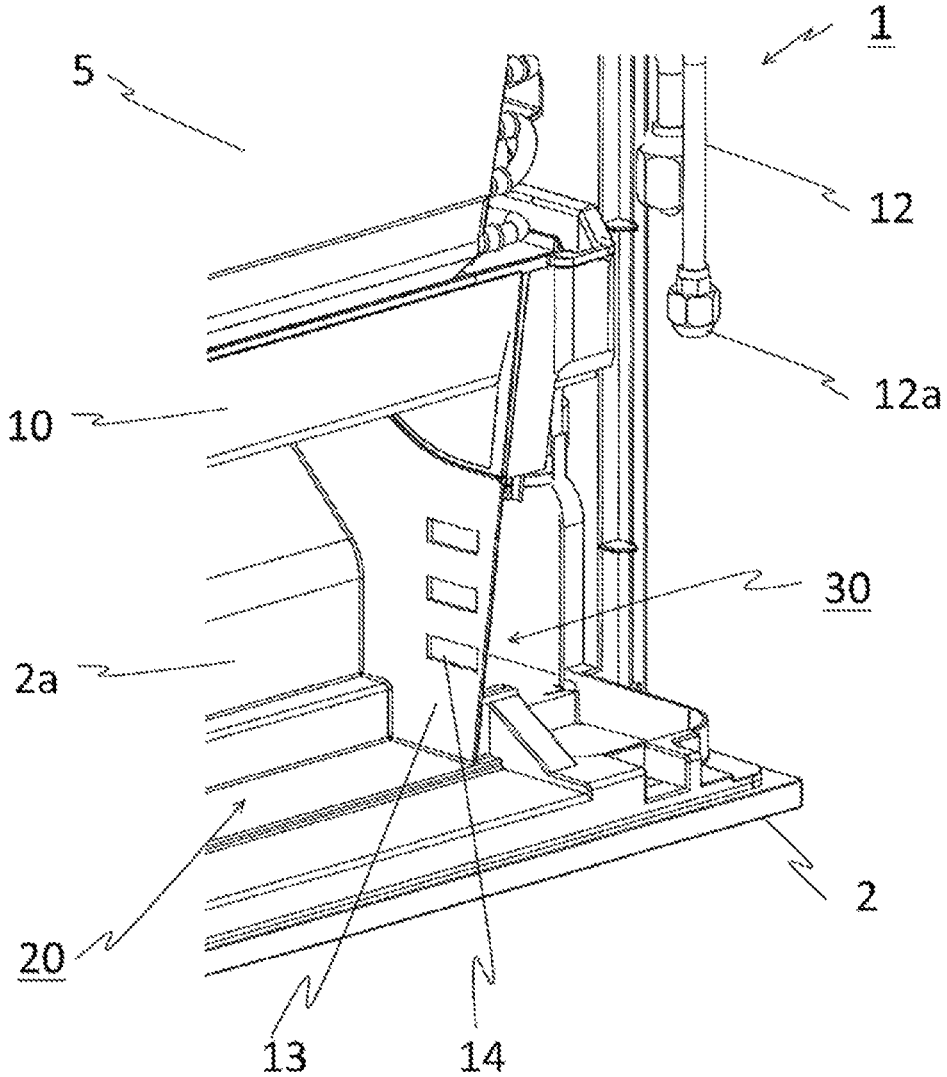
FIG. 3 is an enlarged perspective view magnifying a part around a partition plate of FIG. 2.
Figure 4:
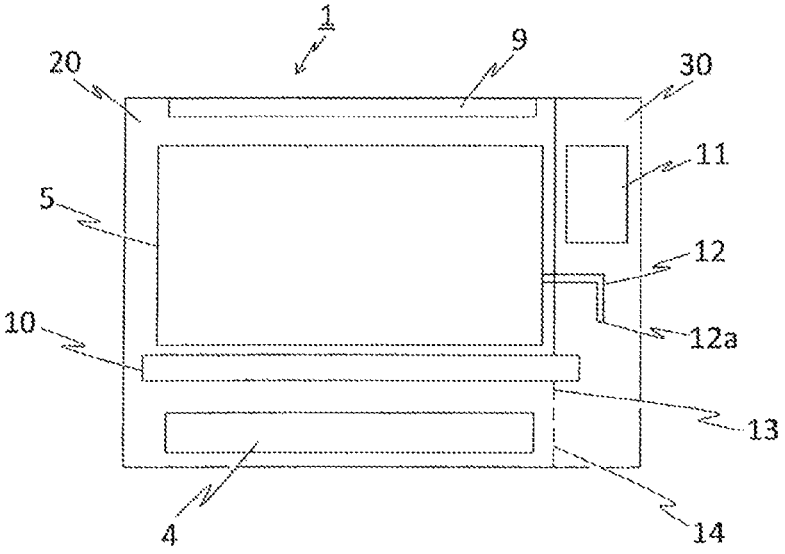
FIG. 4 is a schematic diagram showing a structure of the indoor unit of FIG. 1.
Figure 5:
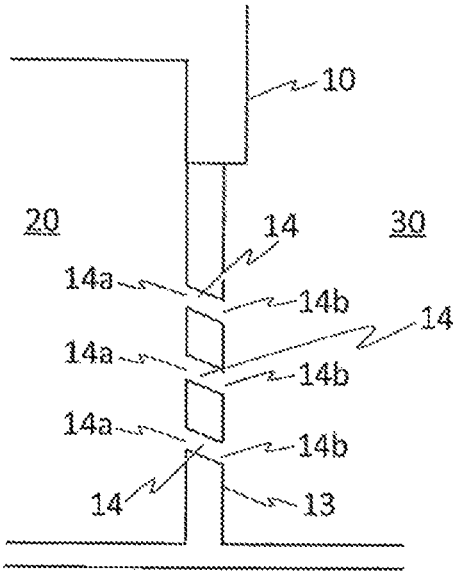
FIG. 5 is a front view magnifying a part around the partition plate of FIG. 4.

FIG. 1 is a sectional view of an indoor unit 1 of an air-conditioning apparatus according to the present embodiment. FIG. 2 is a perspective view of the indoor unit 1 as viewed obliquely, with a front-side casing 2*b*, a front panel 3, and a filter 7 removed. FIG. 3 is an enlarged perspective view magnifying a part around a partition plate 13 of FIG. 2. FIG. 4 is a schematic diagram showing a structure of the indoor unit 1. FIG. 5 is a front view magnifying a part around the partition plate 13 of FIG. 4. The indoor unit 1 can be put on an indoor floor surface to be air-conditioned. The housing 2 is made up of a rear-side casing 2*a* and a front-side casing 2*b*. A front face of the front-side casing 2*b* is configured as the front panel 3. An air inlet 4 for room air is formed in a lower part of the front panel 3. A heat exchanger 5 and a fan 6 are housed in the housing 2. The heat exchanger 5 is a fin-and-tube heat exchanger made up of plural fins 5*a* arranged in parallel and a tube 5*b* penetrating through the fins 5*a*, and is placed substantially in a V shape in side view. The fan 6 is a cross-flow fan configured to send air using a cylindrical runner. Under operating conditions of the indoor unit 1, the room air sucked into the housing 2 through the air inlet 4 by the fan 6 reaches the heat exchanger 5 through the filter 7. The room air subjected to heat exchange with refrigerant flowing through the tube 5*b* of the heat exchanger 5 is sucked up by the action of the fan 6 and blown out of the housing 2 through the air outlet 8 of an air-outlet unit 9 provided above the front panel 3. The air-outlet unit 9 includes a wind flap 9*a* configured to control a wind direction of blown air, and a stabilizer 9*b*. The wind flap 9*a* is pivotal, and FIG. 1 shows a state in which the wind flap 9*a* is open. A drain pan 10 is provided below the heat exchanger 5 to catch dripping drain water caused by heat exchange between air and refrigerant in the heat exchanger 5. The drain pan 10 is a groove-shaped container extending in a horizontal direction in planar view, with a top face of the drain pan 10 being open. The drain water is drained outdoors through a drain hose (not shown) connected to the drain pan 10.

A controller 11 made up of an electric circuit and other elements configured to control operation of the indoor unit 1 and a connection pipe 12 connected to a refrigerant pipe (not shown) of an outdoor unit through a relay pipe (not shown) are provided on a flank of the heat exchanger 5. One end of the connection pipe 12 is connected to the tube 5*b* of the heat exchanger 5, and a connecting portion (hereinafter referred to as a pipe connecting portion) 12*a* connected to the refrigerant pipe of the outdoor unit through a relay pipe is provided at the other end. A connection method of the pipe connecting portion 12*a* is, for example, a flare connection. Hereinafter, a space in which the air inlet 4, the heat exchanger 5, the fan 6, and the air outlet 8 are provided will be referred to as an airflow chamber 20. Also, a space that is located on a flank of the airflow chamber 20 and in which the pipe connecting portion 12*a* is provided will be referred to as a pipe chamber 30. The air inlet 4 is located on a lower side and in front of the airflow chamber 20 and the air outlet 8 is located on an upper side. The room air sucked through the air inlet 4 by the fan 6 is blown out of the air outlet 8 by passing through the heat exchanger 5 and the fan 6. An air course of room air from the air inlet 4 to the air outlet 8 will be referred to as an air course in the indoor unit 1. Note that the relay pipe may be regarded as a part of the refrigerant pipe of the outdoor unit, and the relay pipe and refrigerant pipe may be referred to collectively as a refrigerant pipe of the outdoor unit.

The partition plate 13 is placed on a boundary between the airflow chamber 20 and the pipe chamber 30. The partition plate 13 is provided between a bottom face of the housing 2 and the drain pan 10, partitioning a space below a height position of the drain pan 10 in the housing 2. Communicating paths 14 are formed in the partition plate 13 to communicate the airflow chamber 20 with the pipe chamber 30. That is, the communicating paths 14 are provided below the height position of the drain pan 10. The partition plate 13 is located on a rear side of the front panel 3. Three rectangular communicating paths 14 are formed side by side in the partition plate 13. The communicating paths 14 also include an opening.

The communicating paths 14 formed in the partition plate 13 are inclined toward the air outlet 8. That is, an inlet-outlet 14*a* of each of the communicating paths 14 on the side of the airflow chamber 20 is located closer to the air outlet 8 than a corresponding one of inlet-outlets 14*b* on the side of the pipe chamber 30 is. With this configuration, leaking refrigerant in the pipe chamber 30 tends to be drawn readily into the airflow chamber 20 by an air current flowing from the air inlet 4 toward the air outlet 8 in the airflow chamber 20 and tends to flow readily to the air outlet 8 along with the air current.

If the inlet-outlets 14*a* and 14*b* of the communicating paths 14 are too large, outside air entering the pipe chamber 30 through a gap in a passage hole (not shown) through which a pipe connected to the outdoor unit is passed flows into the airflow chamber 20 in excessive amount during normal operation, and thus a total area of one side of the inlet-outlets 14*a* and 14*b* of the communicating paths 14 is preferably ½ a total area of a corresponding side of the partition plate 13 or smaller. On the other hand, if the inlet-outlets 14*a* and 14*b* of the communicating paths 14 are too small, an amount of leaking refrigerant flowing from the pipe chamber 30 into the airflow chamber 20 becomes too small, and thus the total area of the one side of the inlet-outlets 14*a* and 14*b* of the communicating paths 14 is preferably 1/20 the total area of the corresponding side of the partition plate 13 or larger. That is, the total area of the one side of the inlet-outlets 14*a* and 14*b* of the communicating paths 14 is preferably between 1/20 and ½ the total area of the corresponding side of the partition plate 13 (both inclusive).

To prevent the outside air entering the pipe chamber 30 from flowing into the airflow chamber 20 during normal operation and to make the leaking refrigerant in the pipe chamber 30 to easily flow into the airflow chamber 20 in case of refrigerant leakage, at least one of the communicating paths 14 is desirably formed in a lower part of the partition plate 13, that is, at a position close to the bottom face of the housing 2. For example, at least one of the communicating paths 14 is preferably formed at a position lower than a height position equivalent to ½ a distance between the bottom face of the drain pan 10 and the bottom face of the housing 2. This configuration can make the leaking refrigerant collected at a bottom of the housing 2 on the side of the pipe chamber 30 to easily flow into the airflow chamber 20.

To make the leaking refrigerant in the pipe chamber 30 to more easily flow into the airflow chamber 20, plural communicating paths 14 are preferably provided in the partition plate 13. To draw the refrigerant on the side of the pipe chamber 30 into the airflow chamber 20 before the refrigerant falls onto the bottom face of the housing 2, at least one of the communicating paths 14 is preferably formed also at a position higher than the height position equivalent to ½ the distance between the bottom face of the drain pan 10 and the bottom face of the housing 2. Also, three or more communicating paths 14 may be provided substantially at equal intervals. With this configuration, throughout the flow path down to the bottom face of the housing 2, the refrigerant on the side of the pipe chamber 30 can be drawn into the airflow chamber 20, increasing an amount of leaking refrigerant that is drawn.

Operation of the indoor unit 1 will be described below. The indoor unit 1 includes a receiving unit (not shown) configured to receive a cooling or heating operation command from a remote controller and the controller 11 configured to control cooling operation or heating operation in accordance with contents of the operation command received by the receiving unit. In an air-conditioning apparatus equipped with the indoor unit 1, a refrigeration cycle is formed by the heat exchanger 5 and a compressor of the indoor unit 1 as well as a heat exchanger and expansion valve (not shown) of the outdoor unit, and a cooling or heating effect is achieved when the heat exchanger 5 exchanges heat between the refrigerant flowing in from the outdoor unit (not shown) and room air. The refrigerant can be, for example, a single component refrigerant such as HFO-1234yf (CF3CF=CH2, tetrafluoropropane), HFO-1123 (CF2=CHF), and HFO-1234ze (CF3-CH=CHF) (these refrigerants are referred to as HFO refrigerants), a mixture of such a refrigerant and an HFC refrigerant such as R32, or a hydrocarbon-based refrigerant such as propane (R290). These refrigerants are flammable refrigerants, which burn in the presence of an ignition source when their concentrations in air are equal to or higher than a predetermined level. Note that, according to the present embodiment, a flammable refrigerant also includes mildly flammable refrigerants.

If refrigerant leaks out of the pipe connecting portion 12*a* in the indoor unit 1, the following situation develops. Because refrigerant such as HFO-1234yf is higher in specific gravity than air, the refrigerant leaking out of the pipe connecting portion 12*a* flows toward a bottom of the pipe chamber 30. When the indoor unit 1 is not in cooling or heating operation, the leaking refrigerant accumulates gradually from a bottom of the pipe chamber 30. When an accumulation level of the leaking refrigerant reaches a height at which one of the communicating paths 14 is formed, the leaking refrigerant flows into the airflow chamber 20 from the pipe chamber 30 through the communicating path 14. The refrigerant flowing into the airflow chamber 20 flows out of the indoor unit 1 through the air inlet 4. Consequently, the leaking refrigerant does not accumulate in the pipe chamber 30 and spreads over the indoor floor surface through the air inlet 4 under its own weight. The leaking refrigerant is higher in specific gravity than air and the leaking refrigerant on the floor is pushed successively in a direction away from the indoor unit 1 by leaking refrigerant succeedingly flowing in, spreading widely by creeping along the floor surface. Thus, even when the indoor unit 1 is a floor standing type, the concentration of leaking refrigerant can be kept at or below a flammable concentration.

When the indoor unit 1 is in cooling or heating operation, the refrigerant leaking out of the pipe connecting portion 12*a* and flowing into the airflow chamber 20 from the pipe chamber 30 through the communicating paths 14 is blown out of the indoor unit 1 through the air outlet 8 by an air current of suction air flowing from the air inlet 4 toward the air outlet 8 in the airflow chamber 20. At this time, as the communicating paths 14 are diagonally formed as shown in FIG. 5, the leaking refrigerant tends to be drawn readily into the airflow chamber 20 by the air current of suction air flowing from the air inlet 4 toward the air outlet 8. Consequently, an effect is achieved where the leaking refrigerant does not accumulate in the pipe chamber 30 and spreads more reliably into the room from the air outlet 8.

Thus, the indoor unit 1 of the air-conditioning apparatus according to the present embodiment includes the partition plate 13 placed on the boundary between the airflow chamber 20 and the pipe chamber 30 and configured to partition a space below the height position of the drain pan 10 in the housing 2. The communicating paths 14 configured to communicate the airflow chamber 20 with the pipe chamber 30 are formed in the partition plate 13. This configuration can greatly reduce an amount of outside air entering the pipe chamber 30 through the gap in the passage hole formed in a wall surface to connect the refrigerant pipe to the outdoor unit and flowing into the airflow chamber 20 and improve quality of air-conditioning. That is, the outside air that is not originally targeted for air-conditioning can be prevented from entering the airflow chamber 20 to prevent an unintended temperature and air flow amount of air targeted for air-conditioning. Also, if the refrigerant leaks out of the pipe connecting portion 12*a* in the pipe chamber 30, the leaking refrigerant can be caused to flow into the airflow chamber 20 from the pipe chamber 30 through the communicating paths 14 and flow out of the indoor unit 1 through the air inlet 4 or the air outlet 8. When the indoor unit 1 is not in cooling or heating operation, the leaking refrigerant in the pipe chamber 30 flows into the airflow chamber 20 through the communicating paths 14, and spreads by flowing out onto the indoor floor surface through the air inlet 4 provided on the lower side of the airflow chamber 20. During cooling or heating operation of the indoor unit 1, the leaking refrigerant in the pipe chamber 30 flows into the airflow chamber 20 through the communicating paths 14 and spreads out of the indoor unit 1 into the room through the air outlet 8 by being carried by the air current of suction air flowing from the air inlet 4 toward the air outlet 8. Consequently, if refrigerant leaks, the leaking refrigerant can be spread out of the indoor unit 1 and reduced in concentration to or below a flammable concentration. In particular, as the communicating paths 14 are provided below the height position of the drain pan 10, even if refrigerant leaks in the pipe chamber 30, the leaking refrigerant hardly accumulates in the pipe chamber 30 and can be spread quickly and reliably out of the indoor unit 1. Also, the indoor unit 1 of the air-conditioning apparatus according to the present embodiment eliminates the need for a sensor used to detect refrigerant and can spread leaking refrigerant at low cost. Also, if refrigerant leaks during standby for heating or cooling operation, the leaking refrigerant can be released quickly out of the indoor unit 1 through the air inlet 4 even without operating the fan 6. Consequently, the need for particular control is eliminated, providing the advantage of simplifying the configuration. Unlike Patent Literatures 2 and 3, as the communicating paths 14 are provided in the partition plate 13 inside the indoor unit 1, the indoor unit 1 can be installed easily.

Embodiment 2

Figure 6:
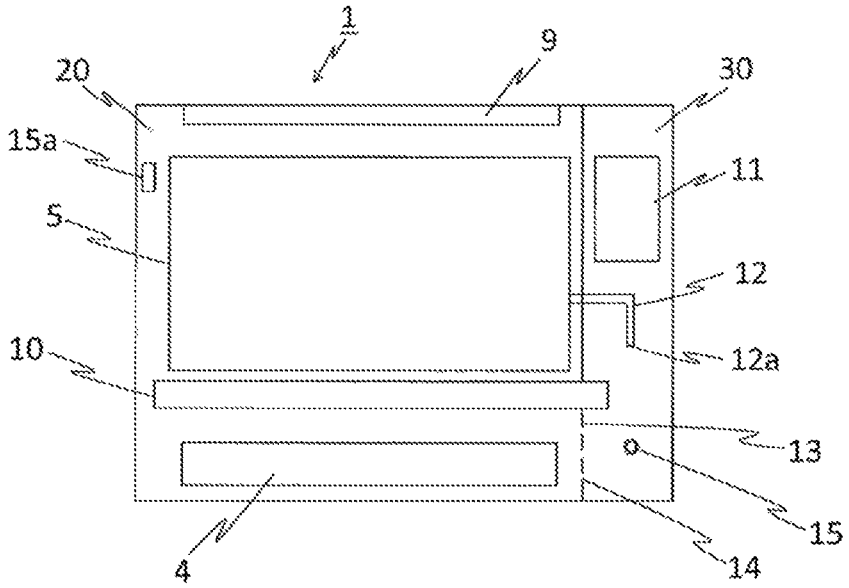
FIG. 6 is a schematic diagram showing a structure of an indoor unit of an air-conditioning apparatus according to Embodiment 2 of the present invention.

FIG. 6 is a schematic diagram showing a structure of an indoor unit 1 of an air-conditioning apparatus according to Embodiment 2 of the present invention. Differences from Embodiment 1 will mainly be described below. In the indoor unit 1 according to the present embodiment, a refrigerant detection sensor 15 is provided in the housing 2 to detect refrigerant leakage. The refrigerant detection sensor 15 is provided in the pipe chamber 30. When the indoor unit 1 is in a standby state and not in cooling or heating operation, if refrigerant leakage is detected by the refrigerant detection sensor 15, the controller 11 operates the fan 6. With this configuration, if refrigerant leakage is detected when the indoor unit 1 is on standby, the leaking refrigerant flowing into the airflow chamber 20 from the pipe chamber 30 through the communicating paths 14 spreads out of the indoor unit 1 through the air outlet 8 by being carried by the air current generated by the fan 6. Consequently, even when the indoor unit 1 is on standby, the leaking refrigerant can be widely spread out of the indoor unit 1 reliably.

Also, if refrigerant leaks from a refrigerant pipe, such as the tube 5*b* of the heat exchanger 5, in the airflow chamber 20, the leaking refrigerant flows out from the air inlet 4, and at the same time can flow into the pipe chamber 30 from the airflow chamber 20 through the communicating paths 14. Also, in this case, the refrigerant detection sensor 15 detects the refrigerant leakage and the controller 11 operates the fan 6, thereby spreading the leaking refrigerant out of the indoor unit 1 through the air outlet 8. As described above, even if refrigerant leaks in the airflow chamber 20, the leaking refrigerant can be widely spread out of the indoor unit 1 through the air outlet 8. Note that whereas FIG. 6 is an example in which the refrigerant detection sensor 15 is provided in the pipe chamber 30, the refrigerant detection sensor 15 may be provided in the airflow chamber 20. Also, in this case, a similar operation can achieve similar effects. Also, a temperature detection sensor 15*a* may be provided separately in the housing 2. If refrigerant leaks, heat in the housing 2 is removed by evaporation of the leaking refrigerant, lowering temperature in the housing 2. The indoor unit 1 may be configured such that the refrigerant is detected by the refrigerant detection sensor 15 and that the controller 11 operates the fan 6 when a temperature obtained by the temperature detection sensor 15*a* falls below a preset temperature. With this configuration, refrigerant leakage detection accuracy can be improved, and if refrigerant leaks, the leaking refrigerant can be widely spread out of the indoor unit 1.

As a variation, the indoor unit may be configured such that, without providing the refrigerant detection sensor 15, the controller 11 operates the fan 6 when the temperature obtained by the temperature detection sensor 15*a* falls below a preset temperature. With this configuration, the leaking refrigerant can be widely spread out of the indoor unit 1 using only the temperature detection sensor 15*a*.

Embodiment 3

Figure 7:
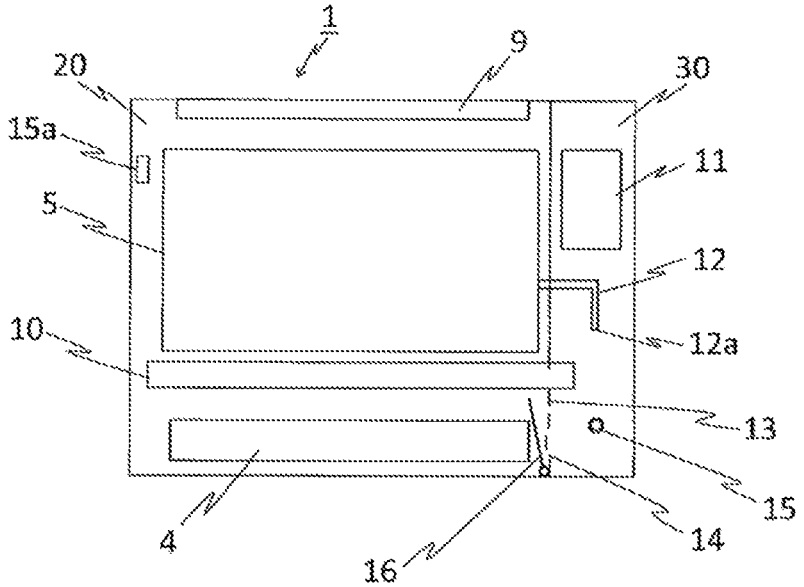
FIG. 7 is a schematic diagram showing a structure of an indoor unit of an air-conditioning apparatus according to Embodiment 3 of the present invention.

FIG. 7 is a schematic diagram showing a structure of an indoor unit 1 of an air-conditioning apparatus according to Embodiment 3 of the present invention. Differences from Embodiment 1 will mainly be described below. In the indoor unit 1 according to the present embodiment, a refrigerant detection sensor 15 is provided in the housing 2 to detect refrigerant leakage. Also, the indoor unit 1 is provided with an opening and closing mechanism 16 capable of opening and closing the communicating paths 14 in the partition plate 13. The opening and closing mechanism 16 can be configured as an opening and closing plate such as a damper. In the example of FIG. 7, the opening and closing mechanism 16 is provided pivotally as a damper 16 close to the partition plate 13 in the airflow chamber 20. The controller 11 rotates and fixes the damper 16 to a position to close the communicating paths 14 when no refrigerant leakage is detected by the refrigerant detection sensor 15 and opens the communicating paths 14 by rotating the damper 16 in a direction away from the communicating paths 14 when refrigerant leakage is detected. That is, according to the present embodiment, when no refrigerant leakage is detected by the refrigerant detection sensor 15, the communicating paths 14 are closed, blocking the flow of gas between the pipe chamber 30 and the airflow chamber 20. When refrigerant leakage is detected, the communicating paths 14 are opened, causing the refrigerant leaking into the pipe chamber 30 to flow into the airflow chamber 20 and then to spread from the air outlet 8 through operation of the fan 6.

With this configuration, when no refrigerant leaks, as the communicating paths 14 are closed by the opening and closing mechanism 16, gas does not move between the airflow chamber 20 and the pipe chamber 30. Thus, outside air entering the pipe chamber 30 through a gap in a passage hole for the refrigerant pipe formed in a wall surface of an installation room for the indoor unit 1 can be prevented from flowing into the airflow chamber 20 through the communicating paths 14. Consequently, quality of air-conditioning during cooling and heating operation of the indoor unit 1 can improve. Also, when refrigerant leaks, as the communicating paths 14 are open, the leaking refrigerant flows into the airflow chamber 20 from the pipe chamber 30 through the communicating paths 14. Leaking refrigerant flows out from the air inlet 4 under its own weight during standby, and leaking refrigerant spreads out of the outdoor unit through the air outlet 8 by being carried by the air current generated by operation of the fan 6 during heating or cooling operation. As described above, the indoor unit 1 according to the present embodiment achieves the effect of being able to spread leaking refrigerant widely out of the indoor unit 1 without degrading quality of air-conditioning.

Figure 8:
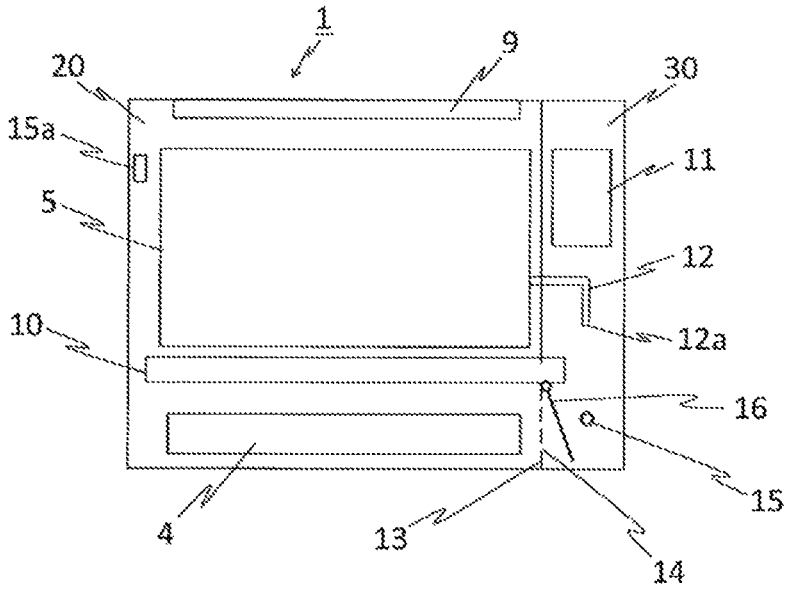
FIG. 8 is a font view showing a variation of the indoor unit of FIG. 7.

FIG. 8 is a schematic diagram showing a variation of the indoor unit 1 of FIG. 7. The damper 16 is installed pivotally close to the partition plate 13 in the pipe chamber 30. The rest of the configuration is similar to FIG. 7. The configuration in FIG. 8 can achieve effects similar to that of FIG. 7 through an operation similar to FIG. 7. Also, in addition to opening and closing of the communicating paths 14 in the present embodiment, similarly to Embodiment 2, when the indoor unit 1 is in a standby state and not in cooling or heating operation, the fan 6 can be operated when refrigerant leakage is detected by the refrigerant detection sensor 15. This operation can achieve effects similar to FIG. 2 as well.

Also, when refrigerant leakage is detected by the refrigerant detection sensor 15, the controller 11 can issue an abnormality alarm as well as operate the fan 6. For example, an alarm lamp (not shown) can be provided on the front panel 3, and an alarm can be issued to the user by blinking the alarm lamp. Also, for example, a speaker (not shown) can be provided on the indoor unit 1, and an alarm can be issued to the user by producing a warning sound from the speaker. As described above, when refrigerant leakage is detected, by issuing an auditory or visual alarm to the user while opening the communicating paths 14 and spreading the leaking refrigerant quickly, subsequent measures against the refrigerant leakage can be taken promptly.

Embodiment 4

Figure 9:
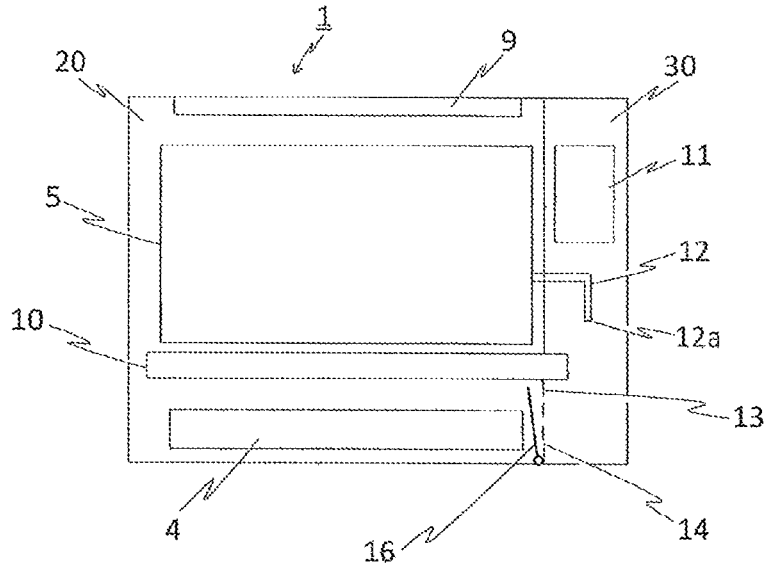
FIG. 9 is a schematic diagram showing a structure of an indoor unit of an air-conditioning apparatus according to Embodiment 4 of the present invention.

FIG. 9 is a schematic diagram showing a structure of the indoor unit 1 of the air-conditioning apparatus according to Embodiment 4 of the present invention. Differences from Embodiment 1 will mainly be described below. The indoor unit 1 is provided with an opening and closing mechanism 16 capable of opening and closing the communicating paths 14 in the partition plate 13. The opening and closing mechanism 16 can be configured, for example, as an opening and closing plate such as a damper. In the example of FIG. 9, the opening and closing mechanism 16 is provided pivotally as a damper 16 close to the partition plate 13 in the airflow chamber 20. The controller 11 opens and closes the inlet-outlets 14*a* and 14*b* of the communicating paths 14 by periodically rotating the damper 16. The period is, for example, 5 seconds to 3 minutes. That is, the present embodiment causes the gas in the pipe chamber 30 to flow into the airflow chamber 20 periodically and then to spread from the air outlet 8 through operation of the fan 6.

With this configuration, when no refrigerant leaks, even when outside air flows into the pipe chamber 30 through the gap in the passage hole for use to pass the refrigerant pipe connected to the outdoor unit, as the outside air can flow into the airflow chamber 20 only periodically, the quality of air-conditioning during cooling or heating operation of the indoor unit 1 is hardly degraded. That is, the outside air that is not originally targeted for air-conditioning can be prevented from entering the airflow chamber 20 to prevent deviations from an intended temperature and air flow amount of air targeted for air-conditioning. On the other hand, when refrigerant leaks, as the leaking refrigerant in the pipe chamber 30 can be caused to periodically flow into the airflow chamber 20 and spread out of the outdoor unit through the air outlet 8, the concentration of leaking refrigerant in the pipe chamber 30 can constantly be kept at or below a lower limit of flammable concentration. Also, as no sensor is needed to detect refrigerant, the configuration also achieves the effect of keeping down cost.

The numbers, shapes, and sizes of communicating paths 14 according to Embodiments 1 to 4 above are exemplary and the present invention is not limited to the examples. At least one communicating path 14 may be formed in the partition plate 13. The shape of the communicating path 14 in planar view of the partition plate 13 is not limited to a rectangular shape, and may be any shape such as another polygonal shape and a circular shape. Also, the communicating paths 14 may be formed perpendicularly to a surface of the partition plate 13 instead of being inclined to the surface of the partition plate 13. That is, one of the inlet-outlets 14*a* located on the side of the airflow chamber 20 and the corresponding one of the inlet-outlets 14*b* located on the side of the pipe chamber 30 of the communicating paths 14 may be set at a same height position.

On a side higher than a height position at which the drain pan 10 is provided, the airflow chamber 20 and the pipe chamber 30 do not necessarily have to be divided from each other. Also, on the higher side, the airflow chamber 20 and the pipe chamber 30 may be divided by a structure such as a side plate (not shown) provided on a flank of the heat exchanger 5. On the higher side, even when the airflow chamber 20 and the pipe chamber 30 are divided by a structure such as a side plate, a slight gap may be opened in the structure. From the viewpoint of preventing outside air from entering the airflow chamber 20, the airflow chamber 20 and the pipe chamber 30 are desirably divided on the higher side as well. On the other hand, as leaking refrigerant is higher in specific gravity than air, when the communicating paths 14 are provided at a position lower than the height position at which the drain pan 10 is provided, the effect can be achieved where the leaking refrigerant is caused to flow out of the indoor unit 1 quickly. These cases also can each achieve effects similar to those of the embodiments described above.

Embodiments 1 to 4 above are examples in which the partition plate 13 is provided as an independent member as shown in FIGS. 2 and 3, and the partition plate 13 is not limited to the examples. For example, the partition plate 13 may be formed integrally with the front panel 3. That is, the partition plate 13 may be configured as a part of the front panel 3. Similarly, the partition plate 13 may be configured as a part of the housing 2 or the drain pan 10. These cases also can each achieve effects similar to those of Embodiments 1 to 4 above.

Embodiments 2 and 3 above are examples in which the refrigerant detection sensor 15 is provided in the pipe chamber 30, and the refrigerant detection sensor 15 is not limited to the examples. The refrigerant detection sensor 15 may be provided in the airflow chamber 20. Even in this case, refrigerant leaking in the pipe chamber 30 and flowing into the airflow chamber 20 through the communicating paths 14 as well as refrigerant leakage in the airflow chamber 20 can be detected. To install the refrigerant detection sensor 15 in the airflow chamber 20, the refrigerant detection sensor 15 is preferably provided at a position lower than a height position of a bottom of the drain pan 10. At this position, if refrigerant leaks from the heat exchanger 5, the leakage of the refrigerant higher in specific gravity than air and overflowing from the drain pan 10 can be detected quickly. Also, when the refrigerant detection sensor 15 is installed in the airflow chamber 20, the refrigerant detection sensor 15 is more preferably provided at a position lower than height position of the communicating paths 14. At this position, if refrigerant leaks in the pipe chamber 30, the leakage of the refrigerant higher in specific gravity than air and flowing into the airflow chamber 20 through the communicating paths 14 can be detected quickly.

REFERENCE SIGNS LIST

1 air-conditioning apparatus 2 housing 2*a* rear-side casing 2*b* front-side casing 3 front panel 4 air inlet 5 heat exchanger 5*a* fin 5*b* tube 6 fan 7 filter 8 air outlet 9 air-outlet unit 9*a* wind flap 9*b* stabilizer 10 drain pan 11 controller 12 connection pipe 12*a* pipe connecting portion 13 partition plate 14 communicating path 14*a*, 14*b* inlet-outlet of communicating path 15 refrigerant detection sensor 15*a* temperature detection sensor 16 damper 20 airflow chamber 30 pipe chamber

The invention claimed is:

1. An indoor unit of an air-conditioning apparatus, comprising:

a housing in which an air inlet and an air outlet for room air are provided;

a connection pipe provided with a pipe connecting portion connected to a refrigerant pipe of an outdoor unit through a relay pipe;

a heat exchanger configured to exchange heat between refrigerant flowing in from the outdoor unit through the connection pipe and air sucked into the housing;

a fan configured to suck air into the housing through the air inlet, and blow the air subjected to heat exchange by the heat exchanger out of the housing through the air outlet, to generate an air current;

a drain pan provided below the heat exchanger and configured to accumulate drain water caused by the heat exchange between the refrigerant and the air; and a partition plate that is placed on a boundary between an airflow chamber and a pipe chamber, wherein the air inlet, the heat exchanger, the fan, and the air outlet are located in the airflow chamber and are on a first side of the partition plate, the pipe connecting portion is located in the pipe chamber and is on a second side of the partition plate, which is opposite to the first side of the partition plate, the partition plate partitions a space below the height position of the drain pan in the housing, the housing includes a panel, and the inlet is an opening formed in a lower part of the panel;

the air inlet is located below the drain pan, a communicating path is formed in the partition plate to communicate the two parts of the partitioned space with each other, and the refrigerant has a higher specific gravity than air, and the inlet is configured to serve as an outlet for refrigerant that leaks from the pipe connecting portion and passes through the partition plate via the communicating path when the fan is not operating.

2. The indoor unit of an air-conditioning apparatus of claim 1, wherein the communicating path is placed at a position lower than the height position of the drain pan.

3. The indoor unit of an air-conditioning apparatus of claim 1, wherein the communicating path is inclined toward the air outlet.

4. The indoor unit of an air-conditioning apparatus of claim 1, wherein a total area of one side of an inlet-outlet of the communicating path is one half a total area of a corresponding side of the partition plate or smaller.

5. The indoor unit of an air-conditioning apparatus of claim 1, wherein the communicating path comprises three or more communicating paths placed substantially at equal intervals.

6. The indoor unit of an air-conditioning apparatus of claim 1, wherein the communicating path is placed at a position lower than a height position equivalent to one half a distance between a bottom face of the drain pan and a bottom face of the housing.

7. The indoor unit of an air-conditioning apparatus of claim 1, further comprising:

a refrigerant detection sensor configured to detect leakage of the refrigerant; and a controller configured to start the fan when refrigerant leakage is detected by the refrigerant detection sensor during standby for heating or cooling operation.

8. The indoor unit of an air-conditioning apparatus of claim 7, wherein the refrigerant detection sensor is placed in the other part of the partitioned space in which the heat exchanger and the fan are placed, the refrigerant detection sensor is placed at a position lower than a height position of a bottom of the drain pan, and the refrigerant detection sensor is placed at a position lower than a height position of the communicating path.

9. The indoor unit of an air-conditioning apparatus of claim 1, further comprising:

a refrigerant detection sensor configured to detect leakage of the refrigerant;

an opening and closing mechanism configured to open and close the communicating path; and a controller configured to control the opening and closing mechanism to close the communicating path when no refrigerant leakage is detected by the refrigerant detection sensor and control the opening and closing mechanism to open the communicating path when refrigerant leakage is detected by the refrigerant detection sensor.

10. The indoor unit of an air-conditioning apparatus of claim 1, further comprising:

an opening and closing mechanism configured to open and close the communicating path; and a controller configured to control the opening and closing mechanism to periodically open and close the communicating path.

11. The indoor unit of an air-conditioning apparatus of claim 1, further comprising:

a refrigerant detection sensor configured to detect leakage of the refrigerant;

a temperature detection sensor configured to obtain temperature in the housing; and a controller configured to start the fan when refrigerant leakage is detected by the refrigerant detection sensor during standby for heating or cooling operation and the temperature obtained by the temperature detection sensor is lower than a preset temperature.

12. The indoor unit of an air-conditioning apparatus of claim 1, further comprising:

a temperature detection sensor configured to obtain temperature in the housing; and a controller configured to start the fan when the temperature obtained by the temperature detection sensor is lower than a preset temperature.

13. The indoor unit of an air-conditioning apparatus of claim 1, wherein the refrigerant is a flammable refrigerant.

14. The indoor unit of an air-conditioning apparatus of claim 13, wherein the flammable refrigerant is HFO-1234yf, HFO-1123, a mixture of HFO-1234yf or HFO-1123 and an HFC refrigerant, or a hydrocarbon-based refrigerant.

15. The indoor unit of an air-conditioning apparatus of claim 1, wherein at least a part of the communicating path is located laterally of the inlet as viewed from a position facing the inlet.

* * * * *